United States Patent [19]

Ryan et al.

[11] 4,176,844

[45] Dec. 4, 1979

Best Available Copy

[54] MULTI-STATION PINBALL GAME

[75] Inventors: Allen L. Ryan, Chicago; Eric G. Jansons, Schaumburg, both of Ill.; Ronald D. Halliburton, Fort Lauderdale; James H. Pearson, Sunrise, both of Fla.

[73] Assignee: Midway Mfg. Co., Franklin Park, Ill.

[21] Appl. No.: 873,908

[22] Filed: Jan. 31, 1978

[51] Int. Cl.[2] ..... A63F 7/00

[52] U.S. Cl. ..... 273/121 A; 273/109

[58] Field of Search ..... 273/109, 110, 118 R, 273/118 A, 119 R, 119 A, 120 R, 120 A, 121 R, 121 A, 123 R, 123 A, 124 R, 124 A, 129 GA, 129 GB, 3 B, 125 A, 127 E; 364/410, 411, 200, 900

[56] References Cited

U.S. PATENT DOCUMENTS

| | | | |
|---|---|---|---|
| 1,022,847 | 4/1912 | Jaccard | 273/120 R |
| 1,055,083 | 3/1913 | Rood | 273/119 R |
| 1,972,381 | 9/1934 | Gensburg | 273/121 R |
| 2,055,566 | 9/1936 | Warner | 273/127 E X |
| 2,056,781 | 10/1936 | Ford | 273/127 E X |
| 2,083,540 | 6/1937 | Armstrong | 273/119 R |
| 2,100,280 | 11/1937 | Goldberger | 273/110 |
| 2,589,839 | 3/1952 | McFerran | 273/121 R |
| 3,117,787 | 1/1964 | Stutzke | 273/129 GA X |
| 3,404,888 | 10/1968 | Lally et al. | 273/121 A |
| 3,452,987 | 7/1969 | DiMotta | 273/110 |
| 4,093,232 | 6/1978 | Nutting et al. | 273/121 A |
| 4,130,280 | 12/1978 | Lowell | 273/125 A X |

FOREIGN PATENT DOCUMENTS

| | | | |
|---|---|---|---|
| 417154 | 8/1925 | Fed. Rep. of Germany | 273/119 R |
| 531815 | 11/1921 | France | 273/127 E X |
| 405860 | 2/1934 | United Kingdom | 273/121 R |

*Primary Examiner*—Vance Y. Hum

*Attorney, Agent, or Firm*—Robert E. Wagner; Thomas L. Kautz

[57] ABSTRACT

A multi-station pinball game is provided by the present invention having a rotatable playfield controlled by a programmable microprocessor which selectively indexes the playfield to each individual station, in a desired order, for sequential play of the game by several players seated around the playfield at their individual playing stations.

7 Claims, 7 Drawing Figures

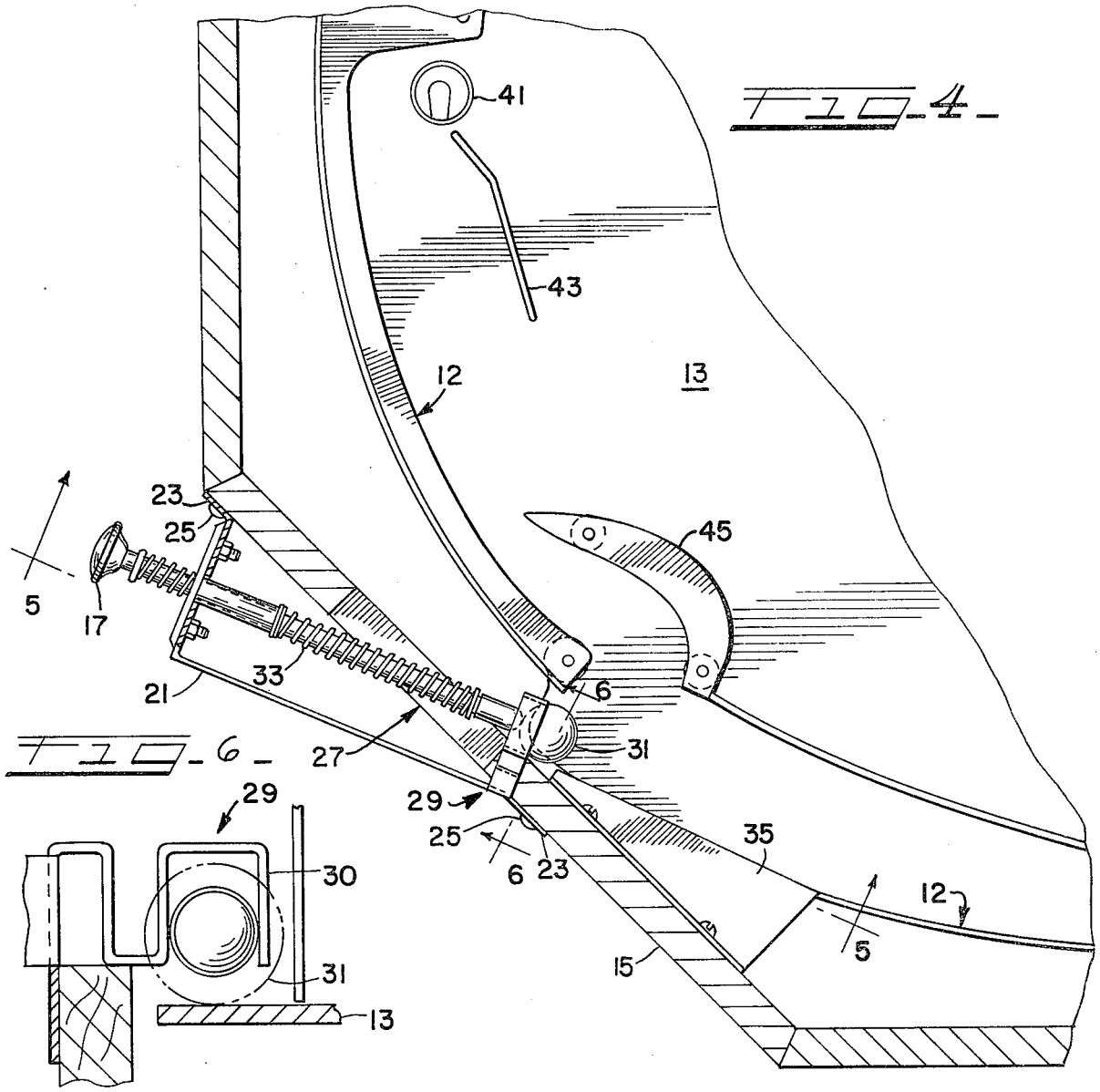
FIG. 4
FIG. 6
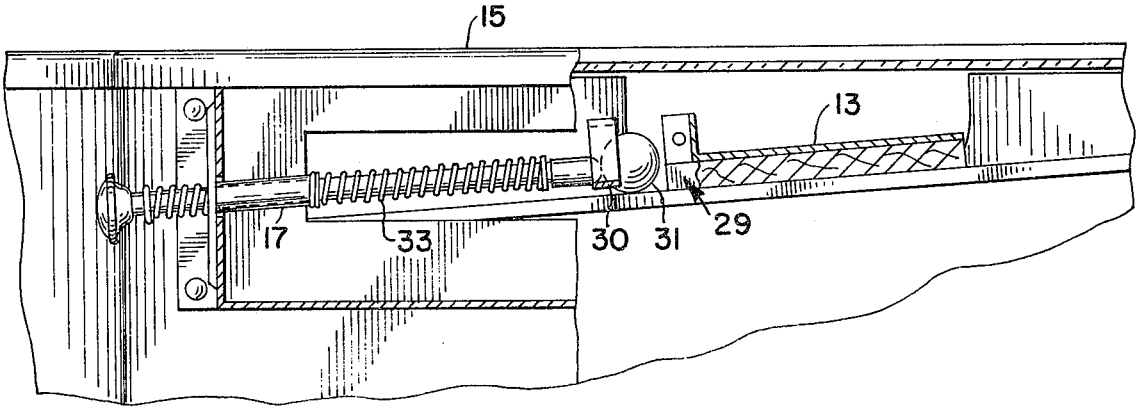
FIG. 5

MULTI-STATION PINBALL GAME

BACKGROUND OF THE INVENTION

The present invention relates to an amusement game and apparatus, and more specifically, to a pinball game having a playfield rotatable about a central axis of the game cabinet to any one of a plurality of playing positions, which rotation is accomplished by electrically controlled drive means.

As is well known, conventional pinball machines include a playing surface or playfield having a plurality of scoring bumpers and other scoring means disposed in a particular design on the surface. A ball is shot onto the playfield by a mechanical shooter where it contacts the scoring bumpers or other means, and points are registered on a visual display. The playfield is normally disposed at a slight angle to the horizontal within a cabinet so that gravitational forces cause the ball to more downwardly along the playfield toward a ball receiving hole or pocket which may be guarded on either side by manually actuable flippers. The players activate the flippers by pressing buttons mounted on the cabinet to strike the ball as it approaches the pocket to move it back to the elevated end of the playfield so that additional points may be scored.

A limitation inherent in many existing pinball machines described above, is that they may be used by only one player at a time. If players wish to compete against one another, each successive player must wait until the player before has completed his game. Some machines are provided with multiple scoring displays which record the scores of a number of players as each successive ball is played during a game. While such machines permit competition among players on each ball in a game, the problem of limited involvement of the other players while they are waiting their turn remains. In both types of existing machines, only one playing station is provided from which the ball may be shot and the flippers activated. Every time it is another player's turn to play, the participants must physically move around and change positions. If other players wish to watch play while awaiting their turn, they must stand around the playfield so that they may move into position to play when it is their turn.

It has been found that it is inconvenient and time consuming for players to constantly change positions in order to play. In addition, very often there is a tendency for players to lose interest in the play of others, as players sit down to relax or are otherwise blocked from viewing the playfield. These disadvantages are overcome by the present invention.

SUMMARY OF THE INVENTION

The present invention provides a pinball game apparatus in which several players are each provided with an individual playing position or station where they can watch the play of others and wait their turn to play while sitting down. The apparatus includes a generally circular playfield disposed at a slight angle within a cabinet. The players are seated at playing stations around the cabinet, from which the play of others can be readily viewed. The playfield is rotatable about a central axis of the cabinet to each station permitting the players to remain comfortably seated at their individual stations and wait until the playfield rotates to their station to play their ball. No moving of players to a single station, or standing around waiting for one's turn to play is required with the present invention. In contrast to existing pinball machines, players using the present invention relax and enjoy each others' play without moving or straining to see the action on the playfield.

As discussed in detail below, an electrically controlled drive means is provided to register the playing surface to the appropriate playing position or station. The microprocessor is programmable to move the playing surface to the stations in any desired sequence, and one or more balls may be played at each station, as desired, before the playfield is moved to the next station.

Each station is provided with a separate ball shooter and flipper buttons are disposed on the surfaces of the game cabinet adjacent the ball shooters to permit the player at each station to display his skill. Circuitry is provided to permit the buttons associateed with the playing station being used to activate the flippers on the playing surface. Play of the game of the present invention is similar to existing pinball machines in that a ball is shot on to the playfield and points are counted as the ball contacts the bumpers and other scoring means disposed in a particular design on the playfield. The playfield is tilted to cause the ball to move downwardly toward the flippers at the base of the playfield, which flippers are disposed on either side of a ball receiving pocket.

When the ball is lost out of play and rolls into the pocket between the flippers at the lower part of the playing surface, the microprocessor is activated to cause the entire playfield to rotate to the next designated playing position. When that position is reached, the ball is ejected from the pocket and guided into position in front of the ball shooter at the new playing position. Once the ball rolls out of play into the pocket at the new position, the microprocessor is again activated to register the playing surface to the next position in sequence, and so on.

Accordingly, it is an object of the present invention to provide a multi-station pinball machine having a playing surface disposed in a cabinet, which playing surface is rotatable about a central axis of the cabinet to selected individual playing stations or positions.

It is another object of the present invention to provide a pinball machine having a microprocessor which is programmable to cause a rotatable playing surface to register to individual playing stations in a desired sequence.

It is still another object of the present invention to provide a pinball machine having multiple playing stations, which are each provided with a separate ball shooter and flipper buttons.

It is a further object of the present invention to provide a pinball machine having a rotatable playing surface which surface is caused to index to the next selected playing station when the ball rolls out of play into the ball return pocket.

It is a further object of the present invention to provide a pinball machine having a rotatable playing surface, including means to eject the ball from the ball return pocket after the playfield has rotated to a new playing station, and guide means to direct the ball, once ejected, into alignment with the shooter at the new playing station.

It is a still further object of the present invention to provide a pinball machine having a rotor rotatable relative to a shaft mounted on a stator or cabinet, which, in turn, causes the playing surface to rotate.

It is a still further object of the present invention to provide a commutator mounted on the rotor for the transfer of information between the rotor and stator.

DESCRIPTION OF THE DRAWINGS

Objects in addition to those specifically set forth above will become apparent with reference to the following description and drawings wherein:

FIG. 4 is a plan view of a portion of the playfield, including a partial cross section of the shooter means shown receiving a ball to be propelled on to the playfield.

FIG. 5 is a cross-sectional view taken generally along line 5—5 of FIG. 4 showing the mounting of the shooter means on the cabinet, and the guide means integral with the end of the shooter means.

FIG. 6 is a cross-sectional view taken along line 6—6 of FIG. 4 showing the aligning bracket of the shooter mounting means for placing the ball in alignment with the shooter.

DETAILED DESCRIPTION OF THE INVENTION

Figure 1:
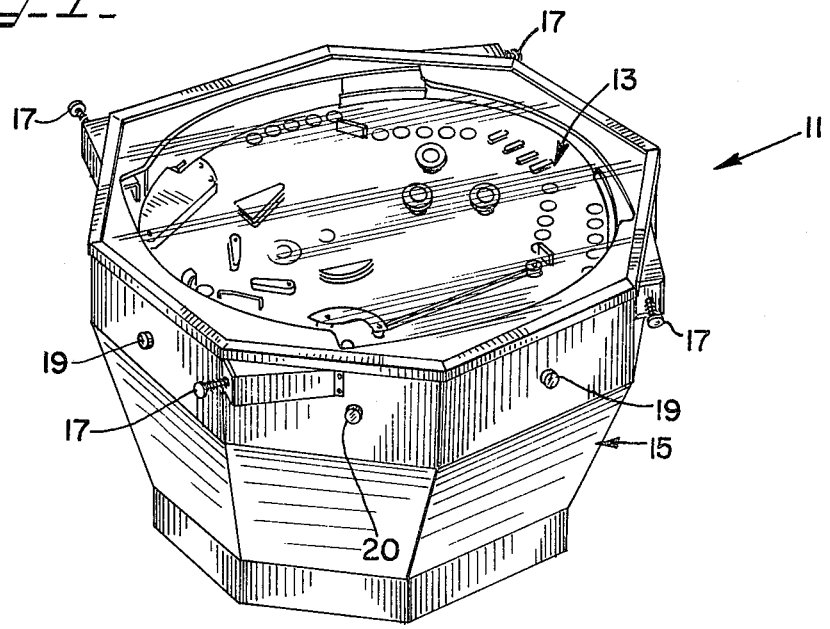
FIG. 1 is a perspective view of the present invention showing a playfield disposed within a generally circular cabinet having four shooters positioned at spaced intervals around its circumference and flipper buttons corresponding to each shooter.

Referring now to FIG. 1, the game apparatus of the present invention is labeled generally as 11. In the embodiment of FIG. 1, the game apparatus 11 includes a playfield 13 which is disposed at a slight angle of a few degrees to the horizontal (see FIG. 3), within a cabinet 15. The playfield 13 may be generally circular in shape and is provided with a plurality of scoring and fixed bumpers and other means for scoring points common to prior art pinball games, which are disposed at selected positions along its surface. The circular shape of playfield 13 adds an interesting dimension to the subject game, as it provides different ball action than standard rectangular-shaped playing surfaces used in many existing machines. It should be understood, however, that the shape and surface design of the playfield 13 and the cabinet 15 may be altered to provide varied playing conditions as desired.

As mentioned above, many existing pinball machines are designed to allow only one player to use the machine at a time. Others must wait for the previous player's game to be completed before they can play. Some machines provide multiple scoring displays which allow two or more players to alternately play successive balls in a game, but only one playing position or station is provided by such machines, and thus players must physically change positions after each ball.

Figure 2:
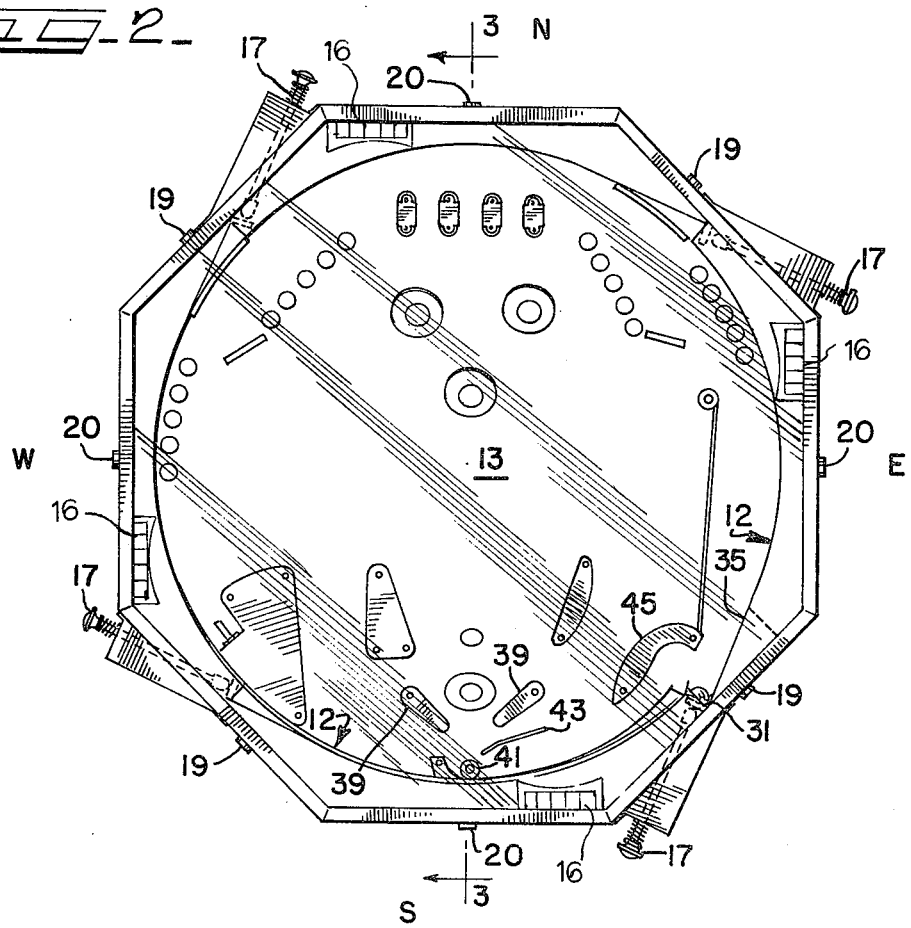
FIG. 2 is a plan view of the present invention showing the orientation of the shooters and one configuration of the play field.

Referring now to FIG. 2, the cabinet 15 is divided into four separate playing positions or stations labeled as N (north), W (west), S (south), and E (east). Each playing station is provided with a shooter 17, which shooters are positioned on the surface of the cabinet 15 and extend inwardly adjacent playfield 13 as shown in FIG. 2. Four flipper buttons 19 are mounted on the cabinet adjacent the shooters 17, and are in easy reach of the players. As discussed below, the playfield 13 is rotated to a playing station and means are provided to guide the ball into alignment with the shooter 17 associated with the playing station. As mentioned above, the two flipper buttons 19 immediately adjacent the playing station are automatically activated for use by the player at such station when the playing field is moved into playing position. The ball is shot by the shooter 17 and play of the game proceeds as in most existing pinball games with players using the flippers to keep the ball in play on playfield 13 as long as possible. The points for each ball are counted and posted on individual scoring displays 16 which may be located at each separate station.

Referring now to FIGS. 4 and 5, the structure of the mechanical shooter 17 is shown in more detail. Shooter 17 is mounted to cabinet 15 by a mounting bracket 21 formed in a right angle and having flanges 23 which are secured to the surface of the cabinet 15 by screws 25. The shooter 17 extends from mounting bracket 21 through an opening 27 in the wall of cabinet 15, to playfield 13. Mounting bracket 21 is formed with a guide flange 29 on the end adjacent playfield 13. As shown in FIGS. 5 and 6, the guide flange 29 includes a downwardly extending U-shaped bracket or cradle 30 which receives and locates the playing ball 31 in precise alignment with shooter 17 where it may be launched into play by pulling and releasing the shooter 17. In addition, guide flange 29 prevents wobbling movement of shooter 17 which may occur as it is drawn back along spring 33 and released to strike the ball 31.

If desired, an electrically operated shooter could be provided in place of the spring actuated mechanical shooter 17 shown in the present embodiment of the game apparatus 11. An electrically operated shooter could consist, for example, of an ejection means which would propel the ball 31 onto playfield 13 in response to a signal from a relay. The ball 31 would, of course, be propelled onto playfield 13 with the same force or velocity in each case using such an electrical shooter.

It has been found that players prefer a mechanical shooter such as the shooter 17 provided by the subject invention. A degree of skill is required in using such mechanical shooters, as the shooter 17 may be pulled back to various positions along spring 33 to propel the ball 31 at different velocities onto playfield 13. Skilled players are able to propel the ball 31 to desired positions at the elevated end of playfield 13 using mechanical shooters, and such positioning of the ball 31 may directly affect a player's score. Electrical shooters, however, do not allow this element of skill to become part of the game.

The mounting bracket 21 and guide flange 29 are combined as a single unit for proper placement through opening 27 and into position on playfield 13. As is apparent, the ball 31 must be properly seated or nested in direct alignment with the path of shooter 17 to assure proper execution of a shot. Guide flange 29 provides such alignment for the shooters 17 at each of the four stations along cabinet 15.

As shown in FIGS. 1 and 2, the shooters 17 are mounted at an angle to the surface of cabinet 15 so that the ball 31 is shot along the outer wall 12 of the playfield 13 toward the top portion of playfield 13 at the N station as shown in FIG. 2. Wedge 35 is provided immediately adjacent the point of impact between shooter 17 and ball 31, to guide the ball 31 along the outer wall 12 of playfield 13 toward its elevated top portion. Thus, as in existing pinball games, play of the subject game is initiated at the top of playfield 13 where any desired combination or design of bumpers and other means to score points is provided. As the ball 31 contacts such bumpers, points are recorded on visual displays 16 which may be disposed on cabinet 15 adjacent each of the respective playing stations as shown in FIG. 2, or in a position on playfield 13. At the lower bottom portion of the tilted playfield 13, a pair of flippers 39 are mounted on either side of a ball receiving opening or pocket 41, which flippers 39 are activated by flipper buttons 19 to strike the ball 31 and shoot it back into play on playfield 13.

In addition to guide flange 29 and cradle 30, the ball 31 is directed into alignment with shooter 17 by a wire bumper 43 and a crescent-shaped guide 45. When the ball 31 is either missed by flippers 39 or otherwise travels to the bottom of playfield 13, it falls into the ball receiving pocket 41. As explained below, this causes the playfield 13 to rotate to another playing station. When registration to the new playing station is completed, the ball 31 is ejected from pocket 41 by sensing means (not shown), and guided into position within the cradle 30 of the guide flange 29. The wire bumper 43, guide 45 and the outer wall 12 of playfield 13 direct the ball 31 toward guide flange 29 and prevent it from re-entering playfield 13. Once the ball 31 is in position against the U-shaped cradle 30 of guide flange 29, in alignment with shooter 17, play may begin at such station.

As mentioned above, a unique feature of the present invention is the provision of a rotatable playfield 13 which may be registered to any of four playing stations along cabinet 15, each of which has its own mechanical or manually operated shooter.

Figure 3:
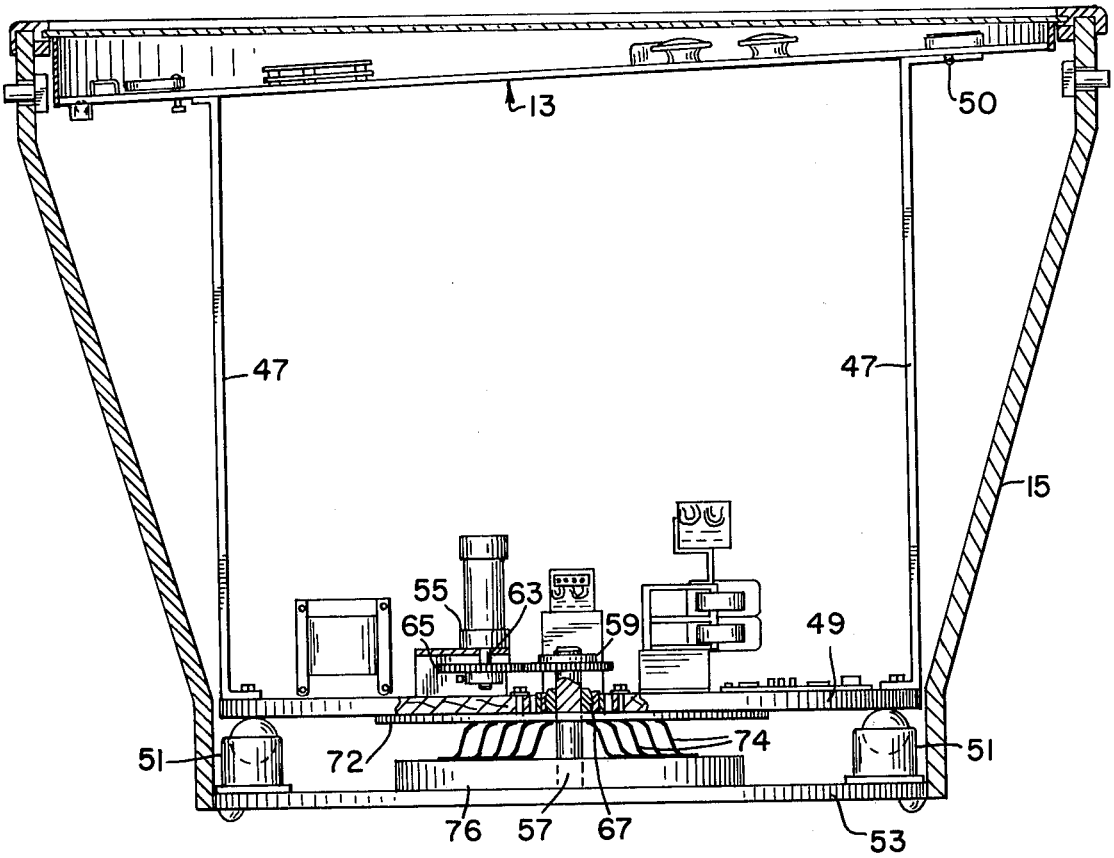
FIG. 3 is a cross-sectional view in full elevation taken along line 3—3 of FIG. 2 showing the playing field disposed at an angle within the cabinet, and the drive means for rotating the playfield.

Referring now to FIG. 3, an overall view of the drive means and structure for rotating playfield 13 is shown. Playfield 13 is mounted on a pair of vertical supports 47, which extend upwardly from the top surface of a rotor 49. The support 47 at the right portion of FIG. 3 is mounted to playfield 13 by a hinge 50, so that one end of the playfield 13 may be lifted upwardly from cabinet 15 to provide access to the inside of cabinet 15 for repairs and the like. As is apparent from FIG. 3, the support 47 at the right portion of the figure is slightly longer than the one at the left so that the playfield 13 is disposed within cabinet 15 at a slight angle to the horizontal, causing the ball 31 to constantly move toward the lower portion of playfield 13 to the ball receiving pocket 41.

The rotor 49 rests on at least three rollers 51, two of which are shown in FIG. 3, which are mounted at approximately 120° intervals on a fixed stator 53. The rotor 49 and stator 53 are connected by a fixed shaft 57 which is mounted to stator 53 and extends upwardly through rotor 49 to a point above its surface. A gear hub 59 is fixed to the upper portion of shaft 57 above the surface of rotor 49. A reversible motor 55, having a drive shaft 63, is mounted on the upper surface of rotor 49 and is provided with a gear 65 which communicates with drive shaft 63 and is movable therewith. Gear 65 is positioned such that its teeth intermesh with the teeth of gear hub 59. As motor 55 is activated, drive shaft 63 causes gear 65 to rotate, and a bearing 67 is provided adjacent shaft 57 to permit the entire rotor 49 to rotate on rollers 51 as gear 65 travels around the circumference of gear hub 59. Of course, other means may be mounted on stator 53 to permit the rotor 49 to rotate thereon, including wheels and the like.

Figure 7:
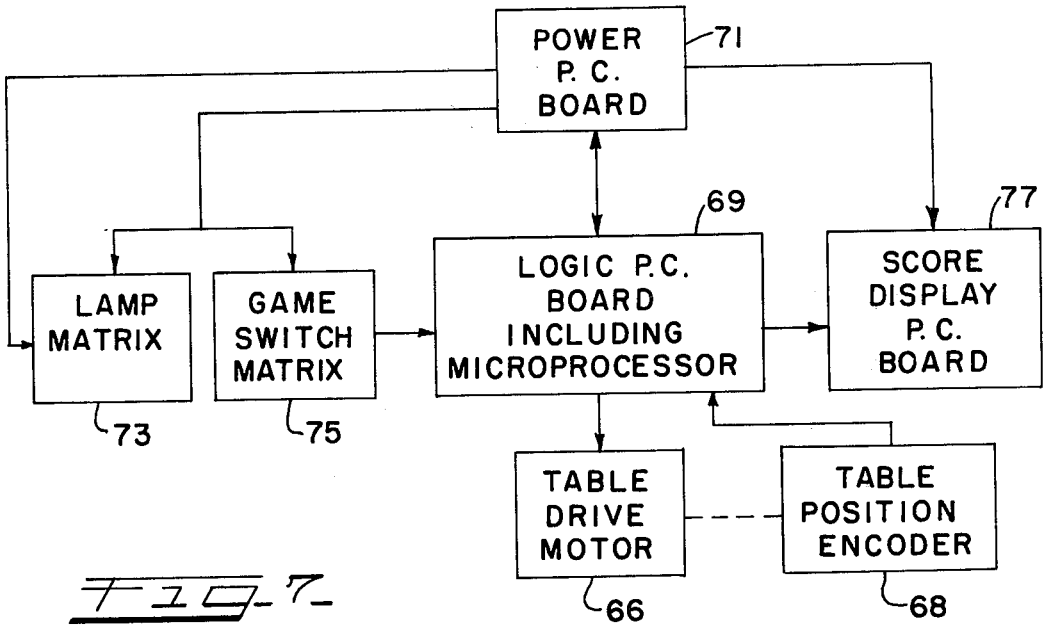
FIG. 7 is a block diagram of the electrical circuitry of the present invention.

The circuitry controlling the drive means described above, is well known in the art and since it does not, per se, form a part of the present invention it is depicted only as a block diagram in FIG. 7. The logic board, labeled generally at 69, includes a commercially available microprocessor which forms the heart of the control circuitry for controlling the table drive motor 66 with reference to the table position encoder 68. The lamp and switch matrices 73 and 75 are associated with playfield 13 and the various bumpers and other means provided to score points. The points are recorded and displayed by a score display board 77. A power printed circuit board 71 connects the source of power to the various blocks of FIG. 7.

The power board 71 is electrically connected to a commutator board 72, which is mounted on the lower surface of rotor 49. Wipers 74 are mounted on a bracket 76 fixed to stator 53, and provide continuous contact with the commutator 72 during the rotation of rotor 49.

As is well known, the microprocessor may be programmed in a relatively simple manner to control the entire operation of the playfield 13 including the scoring and displays and also to activate the drive means at selected intervals, as desired. For example, assume the microprocessor is programmed to register playfield 13 to the N, W, S and E stations in sequence after one ball is played at each station. When ball 31 falls into pocket 41 at the N station, the microprocessor will activate motor 55 to rotate playfield 13 in position at the W station. The ball 31 is then ejected from pocket 41 where it is aligned with the shooter 17 at the W station as described above. The flipper buttons 19 on each side of the W station are then activated by the microprocessor so that the player at such station may proceed with play of his ball.

An order of play is programmed into the microprocessor, and normally the same sequence or pattern will continue for the duration of the game. However, a call button 20 is provided at each station which can override the programmed sequence and "call" the playfield 13 into position at any given station. For example, if the player at N station finishes play of a ball but the player at W station is not present at that time, the S station player can push his call button 20 and the playfield will register to the S station. The programmed sequence of play will then continue in the same order as before.

The particular sequence of play may also be determined by the order the players first shoot their ball. This sequence may be maintained throughout the game by the microprocessor, unless interrupted by an override signal from a call button 20. While the operation of the present invention has been described for play with four players, it should be understood that any number of players up to and including four may play. As is known, the microprocessor may also be programmed to provide any desired playing sequence among two or three players, or the present invention may be used by a single player using only one playing station as in existing pinball games.

In summary, a multi-station pinball game is provided by the present invention having a rotatable playfield controlled by a programmable microprocessor which registers the playfield to each individual station, in a desired order, for sequential play of the game by several individuals.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A pinball game apparatus wherein balls are propelled onto a playfield, said pinball game being suitable for play by a plurality of players in successive turns during a game, comprising:

a cabinet;

a playfield having a single by initiating position, said playfield being mounted on said cabinet, and rotatable relative to said cabinet;

a plurality of discrete playing stations stationarily disposed in spaced relation at fixed positions on said cabinet, each of said playing stations arranged to accommodate a player for play of said game;

a plurality of manually-operable shooter means for selectively propelling the balls onto the playfield, a shooter means being mounted in a fixed position at each of said playing stations, whereby each player may operate a shooter means at a respective playing station; programming means; and, an indexing driver means including electrical control means, said electrical control means being programmable by said programming means to provide power to said indexing driver for rotating said playfield and to selectively stop said playfield to accurately align said play initiating position with the shooter means at each selected playing station, thereby permitting the player at each selected playing station to take a turn at playing said pinball game.

2. A pinball game apparatus comprising:

a cabinet;

a playfield having a single play initiating position, said playfield being mounted on said cabinet and rotatable relative to said cabinet;

a plurality of discrete playing stations stationarily disposed in spaced relation at fixed positions on said cabinet adjacent said playfield;

a plurality of manually operable shooter means, a shooter means being stationarily located at each of said discrete playing stations; and an indexing driver means including data processor control means, said data processor control means being programmable to rotate said playfield and selectively stop said playfield to accurately align said play initiating position with the shooter means of an associated playing station in a desired sequence for permitting the respective player at each playing station to take a turn at playing said pinball game.

3. The game apparatus of claim 2 further including a call means disposed at each of said playing stations, said call means being operable to interrupt the programmed sequence of rotation of said playfield to rotate said play initiating position to the station at which said call means is activated.

4. The game apparatus of claim 2 further including a call means disposed at each of said playing stations, said call means being operable to interrupt the programmed sequence of rotation of said playfield to rotate said play initiating position to the station at which said call means is activated.

5. A pinball game apparatus having a plurality of scoring means actuable upon contact by a ball to register points on a visual score display, said apparatus comprising:

a cabinet;

a playfield having a single play initiating position, said playfield being mounted on said cabinet, and rotatable relative to said cabinet;

a plurality of discrete playing stations stationarily disposed in a spaced relation at fixed positions on said cabinet adjacent said playfield;

a plurality of manually operable shooter means, a shooter means being mounted in a fixed position at each of said discrete playing stations adjacent the periphery of said playfield, said shooter means including a fixed bracket mounted at each of said playing stations for supporting a mechanical shooter, said bracket positioning said mechanical shooter to extend inwardly to said playfield from the periphery thereof at a fixed angle corresponding to the outer wall of said playfield adjacent said shooter means, said bracket having a U-shaped cradle at its inwardly facing end adjacent said playfield for aligning said ball with said mechanical shooter for shooting said ball onto said playfield; and an indexing drive for selectively rotating the playfield to accurately align said play initiating position with a mechanical shooter at the associated playing station for permitting the respective player at each playing station to take a turn at playing said pinball game.

6. A pinball game apparatus comprising:

a cabinet;

a rotatable playfield disposed at a slight angle within said cabinet to form an elevated end and a lower end, said playfield being rotatable about a central axis of said cabinet, said playfield having a play initiating position at said lower end, said playfield including a plurality of scoring means actuable upon contact by a ball to register points, said playfield having manually operable flipper means actuable to affect the path of said ball;

a plurality of playing stations disposed at spaced stationary locations about said cabinet at the periphery of said playfield to accommodate players at each station for play of said pinball game, while permitting each player an unobstructed view of the entire playfield;

mechanical shooter means disposed at each of said playing stations, said shooter means being movably operable to shoot said ball onto said playfield to score points;

drive means for rotating said playfields; and, solid state logic circuitry including a data processor, said data processor being programmable to activate said drive means for rotating said playfield and selectively stopping said playfield to index said play initiating position in accurate alignment with the mechanical shooter means at an associated playing station in sequence, thereby permitting each player to remain at a single playing station while awaiting their turn in said sequence to play said pinball game.

7. A pinball game apparatus having a plurality of scoring means actuable upon contact by a ball to register points on a visual score display, said apparatus comprising:

a cabinet;

a playfield having a single play initiating position, said playfield being mounted on said cabinet and rotatable relative to said cabinet;

a plurality of discrete playing stations stationarily disposed in a spaced relation at fixed positions on said cabinet adjacent said playfield;

a plurality of shooter means, a shooter means being mounted in a fixed position at each of said discrete playing stations adjacent the periphery of said playfield, said shooter means including a fixed mounting means at each of said playing stations for supporting a manually-operable shooter, said mounting means positioning said manually-operable shooter to shoot said ball along the outer wall of said playfield adjacent said shooter means, said mounting means having a cradle adjacent said playfield for aligning said ball with said manually-operable shooter for shooting said ball onto said playfield;

guide means disposed on said playfield adjacent said play initiating position for guiding said ball to said cradle for aligning said ball with said manually-operable shooter to initiate play of said game;

an indexing driver; programming means; and, electrical control means programmable by said programming means to selectively provide power to said indexing driver for rotating said playfield, and to selectively stop said playfield to accurately align said play initiating position with the manually-operable shooter at an associated playing station for permitting the respective player at each playing station to take a turn at playing said pinball game.

* * * * *

UNITED STATES PATENT AND TRADEMARK OFFICE

CERTIFICATE OF CORRECTION

PATENT NO. : 4,176,844

DATED : December 4, 1979

INVENTOR(S) : Allen L. Ryan, Eric G. Jansons, Ronald D. Halliburton and James H. Pearson It is certified that error appears in the above-identified patent and that said Letters Patent are hereby corrected as shown below:

Column 2, line 17, "associateed" should be -- associated --

Column 4, line 50, "Skilled" should be -- Skillful --

Column 7, line 23, "by" should be -- play --

Column 8, line 36, "drive" should be -- driver --

Column 8, line 63, "playfields" should be -- playfield --

Signed and Sealed this

First Day of April 1980

[SEAL]

Attest:

SIDNEY A. DIAMOND

Attesting Officer

Commissioner of Patents and Trademarks